US006129447A

United States Patent [19]

Futami

[11] Patent Number: 6,129,447

[45] Date of Patent: Oct. 10, 2000

[54] AUTOMOBILE LAMP

[75] Inventor: Takashi Futami, Tokyo, Japan

[73] Assignee: Stanley Electric Co., Ltd., Tokyo, Japan

[21] Appl. No.: 09/235,408

[22] Filed: Jan. 22, 1999

[30] Foreign Application Priority Data

Jan. 29, 1998 [JP] Japan ..... 10-017125

[51] Int. Cl.[7] ..... F21V 5/00; F21V 7/00; F21V 11/00

[52] U.S. Cl. ..... 362/522; 362/518; 362/539; 362/351; 362/355; 362/360; 362/361; 362/339; 362/340

[58] Field of Search ..... 362/518, 531, 362/522, 351, 355, 360, 361, 339, 340

[56] References Cited

U.S. PATENT DOCUMENTS

| | | | |
|---|---|---|---|
| 1,463,623 | 7/1923 | McCarthy | 362/518 |
| 1,885,622 | 11/1932 | O'Meara . | |
| 4,542,448 | 9/1985 | Yamai et al. | 362/268 |
| 4,652,979 | 3/1987 | Arima | 362/80 |
| 4,669,034 | 5/1987 | Bansback et al. | 362/339 |
| 4,918,580 | 4/1990 | Nino | 362/518 |
| 5,068,768 | 11/1991 | Kobayashi | 362/539 |
| 5,967,647 | 10/1999 | Eichler | 362/518 |

FOREIGN PATENT DOCUMENTS

3420175 C2 5/1992 Germany .

*Primary Examiner*—Sandra O'Shea
*Assistant Examiner*—Bryan P. Stanley
*Attorney, Agent, or Firm*—Morgan, Lewis & Bockius LLP

[57] ABSTRACT

An automobile lamp comprising a light source, a shade covering the light source, a reflector having an aperture, an outer lens covering the aperture, and an inner lens arranged vertically between the shade and the outer lens, wherein the reflector has a central reflecting surface, which directs light emitted from the light source to the inner lens, a left reflecting surface, a right reflecting surface, and at least one non-reflecting surface which is at least one step between the central reflecting surface and the left or right reflecting surface, and the inner lens covers the central reflecting surface of the reflector. Light distribution patterns are formed by the inner lens, the left reflecting surface, and the right reflecting surface. Light distribution patterns of the automobile lamps are horizontally wide and have high uniformity of luminous flux density distribution. The inner lens of the automobile lamp prevents the inside composition of the lamp from being visible from outside even when viewed at an angle.

20 Claims, 4 Drawing Sheets

AUTOMOBILE LAMP

This invention claims the benefit of Japanese Patent Application No. 10-17125, filed on Jan. 29, 1998, which is hereby incorporated by reference.

BACKGROUND OF THE INVENTION

1. Field of the Invention

The present invention relates to an automobile lamp used as a headlight, a stop lamp, a turn-signal lamp, a back-up lamp, or the like, and more particularly to a composition of the automobile lamp having an outer lens without any prismatic cuts for diffusion or diffraction of reflected light. Light distribution patterns are formed and controlled mainly by a reflector.

2. Discussion of the Related Art

FIGS. 8 and 9 illustrate a conventional automobile lamp 90 comprising a light source 92, a reflector 91 having an aperture, a shade 94 covering the light source 92, and an outer lens 93 covering the aperture of the reflector 91. The reflector 91 has a free-form surface or a complex surface, which is a substantially single smooth curved surface that is not determined by a quadratic curved line, such as a rotated parabolic surface, a parabolic cylinder, a hyperboloid, or a plane. The reflector 91, having a free-form or complex surface, is able to form light distribution patterns itself by controlling reflecting directions of light rays when the light rays emitted from the light source 92 are reflected by the reflector 91. Therefore, no prismatic cut is required for the formation of the light distribution patterns, and the inside composition of the automobile lamp 90, such as the reflector 91, the light source 92, and the shade 94 can be seen from outside through the outer lens 93.

The conventional automobile headlight 90 has the following problems. First, since light that is reflected on the rearmost portion of the reflector 91 is prohibited by an inner side surface of the aperture or an extension of the reflector 91, it is difficult to obtain sufficiently wide light distribution patterns in a horizontal direction. Second, on formation of light distribution patterns by the reflector 91, the reflector 91 is divided into different portions, such as a first reflecting surface for illuminating center front, a second reflecting surface for illuminating left front, and a third reflecting surface for illuminating right front. Reflected light from respective reflecting surfaces combine to form a light distribution pattern. However, since the contour of respective reflecting surfaces are rather conspicuous, the light distribution pattern, comprising light from each reflecting surface, does not seem to have a uniform luminous flux density distribution. The pattern is instead easily perceived as a combination of different reflecting portions having different luminous flux density because of luminous density gaps between the different reflecting portions. Third, since the inside composition of the outer lens 93 can be seen through the outer lens 93, headlight parts that detract from the headlight's aesthetic appearance, such as the base of the light source 92 or the shade 94, can be seen when looking into the headlight 90 from outside in every direction, except when looking through the center front. As a method to prevent the shade 94 and the base from being seen from outside, the outer lens 93 has prismatic cuts 93*a* around a portion corresponding to the shade 94, as depicted in FIG. 9. However, the base of the light source 92 can still be seen when looking into the headlight 90 at an angle from the outside. Additionally, the prismatic cuts 93*a* decrease the uniformity of luminous flux density distribution, since light reflected by the reflector 91, which has already been sufficiently diffused, is further diffused when the light passes through the prismatic cuts 93*a*.

SUMMARY OF THE INVENTION

The present invention is directed to an automobile lamp that substantially obviates one or more of the above problems due to limitations and disadvantages of the related art.

An object of the invention is to provide an automobile lamp capable of providing light distribution patterns with an improved uniformity of luminous flux density distribution, free from any conspicuous luminous flux density gap in the light distribution pattern, which comprises light reflected on respective reflecting surfaces of the reflector having different reflecting portions.

Another object of the invention is to provide an automobile lamp capable of providing a wider light distribution in a horizontal direction.

A further object of the invention is to provide an automobile lamp with an improved appearance from the outside in any direction.

The above objects are achieved by providing an automobile lamp comprising a light source, a shade covering the light source, a generally parabolic surface reflector having an aperture, an outer lens covering the aperture, and an inner lens arranged vertically between the shade and the outer lens, wherein the reflector has a central reflecting surface, which directs light emitted from the light source to the inner lens, a left reflecting surface, a right reflecting surface, and at least one non-reflecting surface which is at least one step between the central reflecting surface and the left or right reflecting surface, and the inner lens covers the central reflecting surface of the reflector. Light distribution patterns are formed by the inner lens, the left reflecting surface, and the right reflecting surface.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DETAILED DESCRIPTION OF THE PREFERRED EMBODIMENTS

Reference will now be made in detail to the preferred embodiments of the present invention. Whenever possible, the same references numbers will be used throughout the drawings to refer to the same or like parts.

Figure 1:
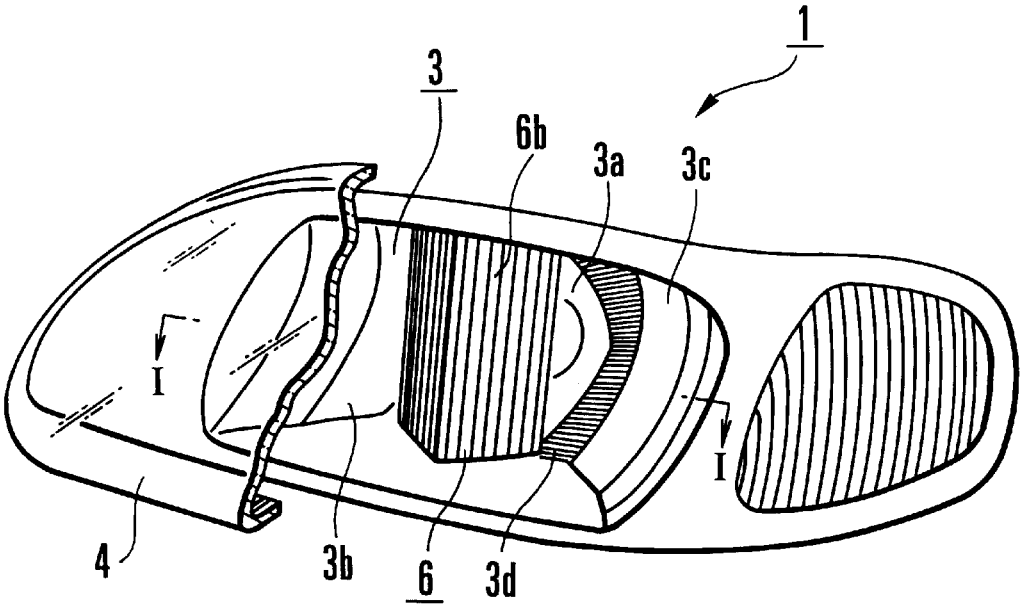
FIG. 1 illustrates a perspective view of a first preferred embodiment of the present invention.
Figure 2:
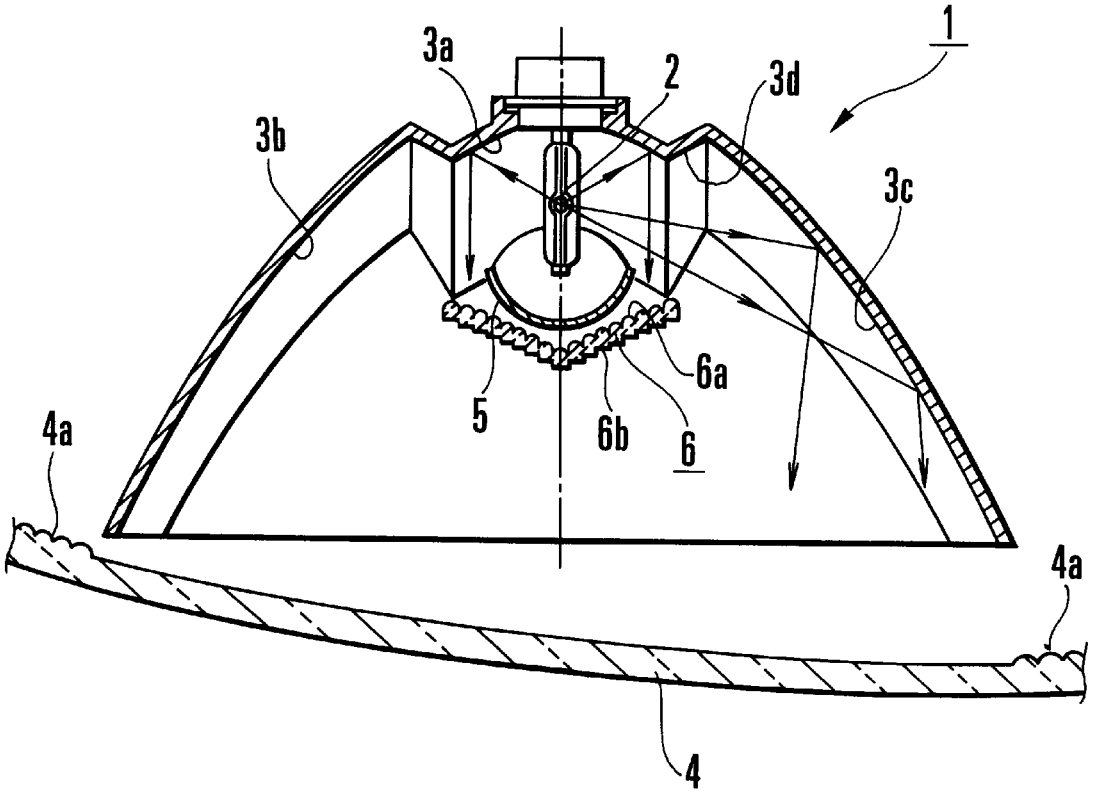
FIG. 2 illustrates a cross-sectional view along a line I—I of the first preferred embodiment of the present invention in FIG. 1.

FIG. 1 illustrates a perspective view of a first preferred embodiment of the present invention, and FIG. 2 illustrates a cross-sectional view along the I—I line of the first preferred embodiment in FIG. 1. An automobile headlight 1 comprises a light source 2 and a reflector 3 to control directions of light rays emitted from the light source 2 to form predetermined light distribution patterns. The reflector 3 is comprised of a central reflecting surface 3*a*, a left reflecting surface 3*b*, a right reflecting surface 3*c*, and non-reflecting surfaces 3*d* that are respectively a step between the central reflecting surface 3*a* and the left reflecting surface 3*b* or between the central reflecting surface 3*a* and the right reflecting surface 3*c*. The headlight also comprises an outer lens 4 that does not have any prismatic cuts to control light distribution patterns, a shade 5 that covers the light source 2, and an inner lens 6 arranged vertically like a wall between the shade 5 and the outer lens 4.

The outer lens 4 may have decorative prismatic cuts 4*a*, as depicted in FIG. 2, in a portion in which light reflected on the reflector 3 does not pass through, for the purpose of preventing the inside composition of the automobile headlight 1 from being seen excessively from outside of the automobile headlight 1.

Light distribution patterns of the automobile headlight 1 are basically formed by light reflected on the left reflecting surface 3*b* and the right reflecting surface 3*c*. The left reflecting surface 3*b* and the right reflecting surface 3*c* are free-form surfaces or complex surfaces. The central reflecting surface 3*a* is a rotated parabolic surface with a focus on the light source 2, which reflects light emitted from the light source 2 in parallel to an optical axis of the light source 2. The focus of the central reflecting surface 3*a* may be positioned between the light source 2 and the central reflecting surface 3*a*.

The inner lens 6 is arranged substantially vertically like a wall between the shade 5 and the outer lens 4, and its shape and position are determined such that only the light reflected on the central reflecting surface 3*a* is incident to the inner lens 6 when the light rays pass through the inner lens 6. The inner lens 6 has prismatic cuts 6*a* on its inner surface for diffusing light reflected by the central reflecting surface 3*a* into a horizontal direction.

It is not preferable that light reflected on the left reflecting surface 3*b* or light reflected on the right reflecting surface 3*c* is incident to the inner lens 6, because the light is excessively diffused by the prismatic cuts 6*a* which causes defective lines in the light distribution patterns. The light has already been sufficiently diffused on the left reflecting surface 3*b* or the right reflecting surface 3*c*.

For preventing light reflected on the left reflecting surface 3*b* or light reflected on the right reflecting surface 3*c* from being incident to the inner lens 6, the focal distance of the left reflecting surface 3*b* and the focal distance of the right reflecting surface 3*c* are each greater than the focal distance of the central reflecting surface 3*a*. Additionally, non-reflecting surfaces 3*d* are arranged in each step between the central reflecting surface 3*a* and the left reflecting surface 3*b*, and between the central reflecting surface 3*a* and the right reflecting surface 3*c*. An angle of the non-reflecting surface 3*d* is determined such that the light emitted from the light source 2 does not directly reach the non-reflecting surfaces 3*d*. As depicted in FIG. 2, the reflecting point on the left reflecting surface 3*b* or the right reflecting surface 3*c* of light rays emitted from the light source 2 is sufficiently away from the reflecting point on the central reflecting surface 3*a* of light emitted from the light source 2, such that only the light reflected on the central reflecting surface 3*a* passes through the inner lens 6.

Since the light emitted from the light source 2 does not reach the non-reflecting portion 3*d*, the non-reflecting portion 3*d* may be painted, colored, or designed to have a pattern or characters for the purpose of achieving an improved appearance of the automobile headlight 1. The pattern or characters are formed by sculpting dies used for formation of the reflector 3.

Figure 3:
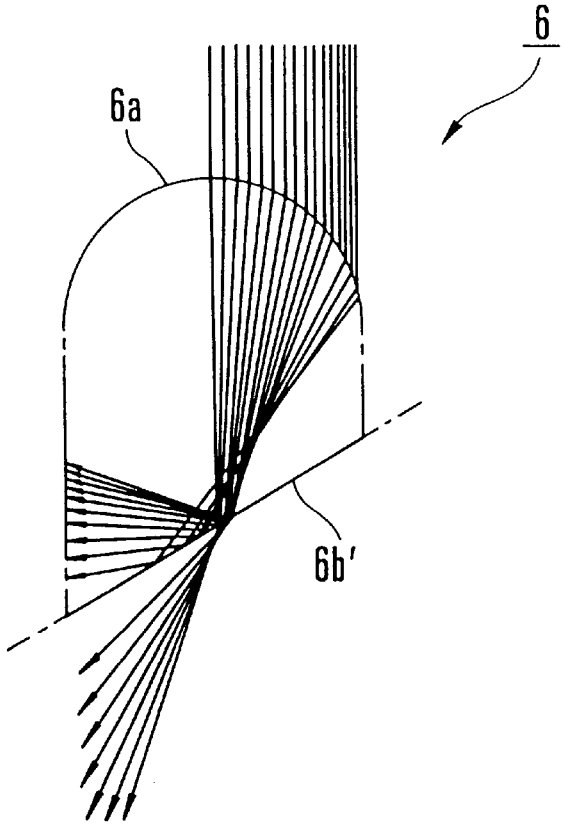
FIG. 3 is a diagram to illustrate directions of light rays when they pass through the substantially V-shaped inner lens having prismatic cuts on its inner surface and having no light transmitting cut on its outer surface.
Figure 4:
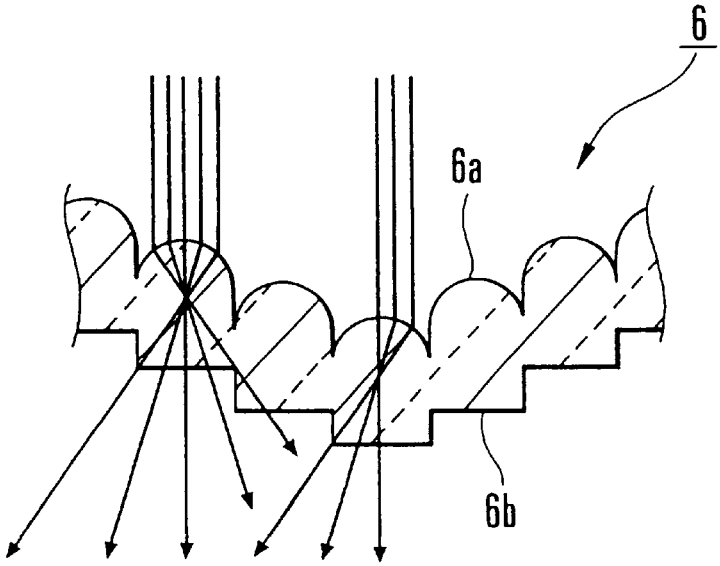
FIG. 4 is a cross-sectional view of the inner lens of the first preferred embodiment of the present invention.

The inner lens 6 is substantially V-shaped having a vertex in the illuminating direction for preventing the base of the light source 2 from being seen from outside of the automobile headlight 1 in slanting directions. As depicted in FIG. 4, prismatic cuts 6*a* are arranged on the inner surface of the V-shaped inner lens 6, and light-transmitting cuts 6*b* are arranged on the outer surface of the V-shaped inner lens 6 like symmetrical stairs, relative to a line passing through the vertex of the V-shape and center of the light source. The prismatic cuts 6*a* may be a series of right circular cylinders in a horizontal cross-sectional view. If the inner lens 6 has no light-transmitting cuts 6*b* on the outer surface 6*b*', as depicted in FIG. 3, internal reflection occurs when light passes through the outer surface 6*b*' of the V-shaped inner lens 6, because the outer surface 6*b*' is slanted relative to the prismatic cuts 6*a*. The internally reflected light becomes an internal loss, because it does not pass through the outer surface 6*b*' of the inner wall lens 6.

Figure 5:
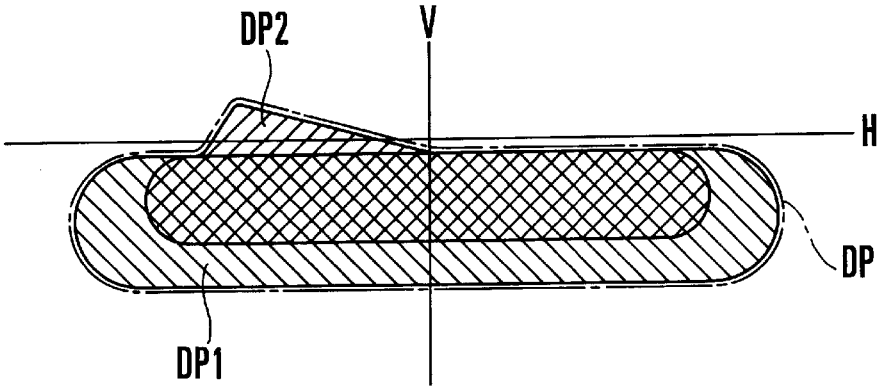
FIG. 5 illustrates a light distribution pattern of the first preferred embodiment of the present invention.

FIG. 5 illustrates a light distribution pattern DP of the automobile headlight 1. The light distribution pattern DP comprises a light distribution pattern DP1 and a light distribution pattern DP2. Light rays emitted from the light source 2 and reflected on the left reflecting surface 3*b* or the right reflecting surface 3*c* pass through the outer lens 4 into predetermined illuminating directions to form the light distribution pattern DP2. Light rays emitted from the light source 2 and reflected on the central reflecting surface 3*a* become parallel relative to the optical axis of the light source 2 and are incident to the inner lens 6. This light is diffused by the prismatic cuts 6*a*, and finally passes through the outer lens 4 in predetermined illuminating directions to form the light distribution pattern DP1.

The light distribution pattern DP1 is free from any defective lines, and luminous flux density gradually decreases from its center to both left and right ends. This luminous flux density distribution is achieved by the inner lens 6. Since the inner lens 6 is positioned closer to the outer lens 4 than the reflector 3 and also has plurality of prismatic cuts 6*a*, the inner lens 6 has wider diffusing angles.

In a comparison of the light distribution patterns between DP, a combination of DP1 and DP2, and just DP1, the light distribution pattern DP has larger horizontal length and more gradual distribution shift of luminous flux density from its center to right or left ends than the light distribution pattern DP2. The non-reflecting surface 3*d* intensifies such characteristics of the light distribution pattern DP, because the non-reflecting surface 3*d* prevents reflected light from the left reflecting surface 3*b,* or light reflected from the right reflecting surface 3*c* from being incident on the inner lens 6.

The outer lens 4 is substantially quadrilateral in the automobile headlight 1, but the outer lens 4 may be circular.

The operational advantages of the automobile headlight 1 according to the preferred embodiment of the present invention will now be described.

First, since the inner lens 6 assists formation and control of the light distribution pattern, a wider light distribution pattern in a horizontal direction is achieved in an automobile lamp 1 having a free-form surface reflector or a complex surface reflector. Second, since the inner lens 6 has prismatic cuts 6*a* on the inner surface, higher uniformity of luminous flux density distribution without any defective lines is achieved. Third, since the inner lens 6 covers the shade 5 and the light source 2, the appearance of the automobile lamp 1 is improved such that the base of the light source 2 cannot be seen from outside even when viewed at an angle.

Figure 6:
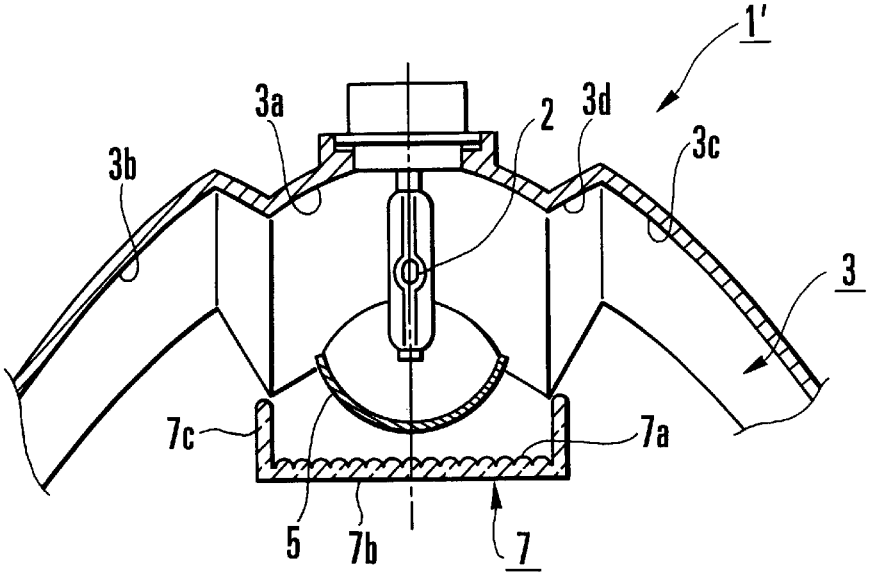
FIG. 6 illustrates a schematic cross-sectional view of the second preferred embodiment of the present invention.

FIG. 6 illustrates a schematic cross-sectional view of the second preferred embodiment of the present invention. The inner lens 6 of the automobile headlight 1 is not limited to being V-shaped. In the automobile headlight 1', an inner lens 7 is substantially U-shaped. The inner lens 7 comprises a plate 7*b,* ribs 7*c* on left and right ends of the plate 7*b,* and prismatic cuts 7*a* on an inner surface of the plate 7*b.* Other shapes are possible, on the condition that the inner lens 7 can diffuse sufficiently and also cover the shade 5 and the light source 2, preventing the base of the light source 2 from being seen from outside when viewed angularly. The outer surface of the inner lens 7 is a flat surface. Since a light-transmitting surface 7*b* is parallel to a series of the prismatic cuts 7*a,* internal reflection does not happen.

Figure 7:
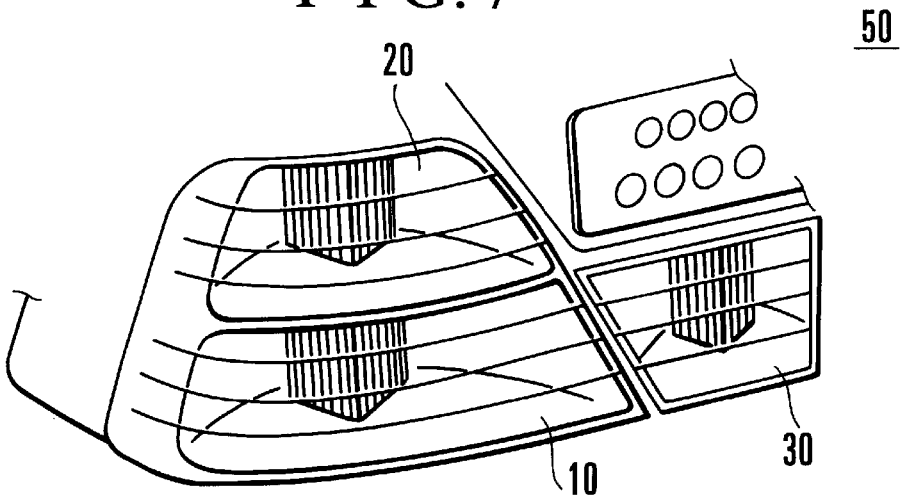
FIG. 7 illustrates a perspective view of the third preferred embodiment of the present invention.
Figure 8:
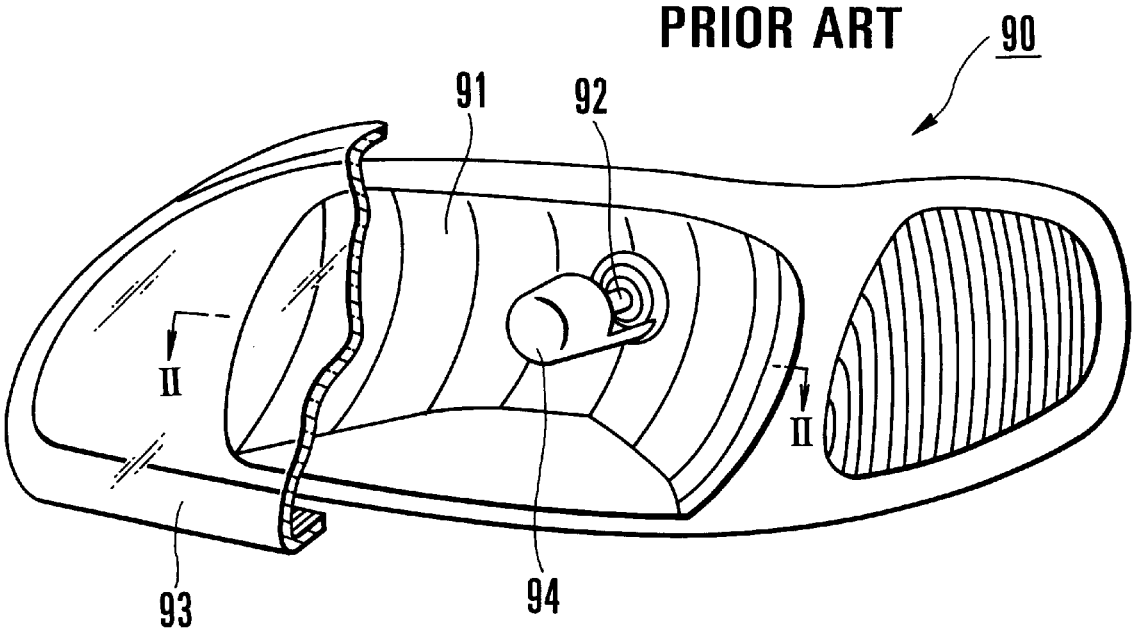
FIG. 8 PRIOR ART
FIG. 8 illustrates a perspective view of a conventional automobile lamp.
Figure 9:
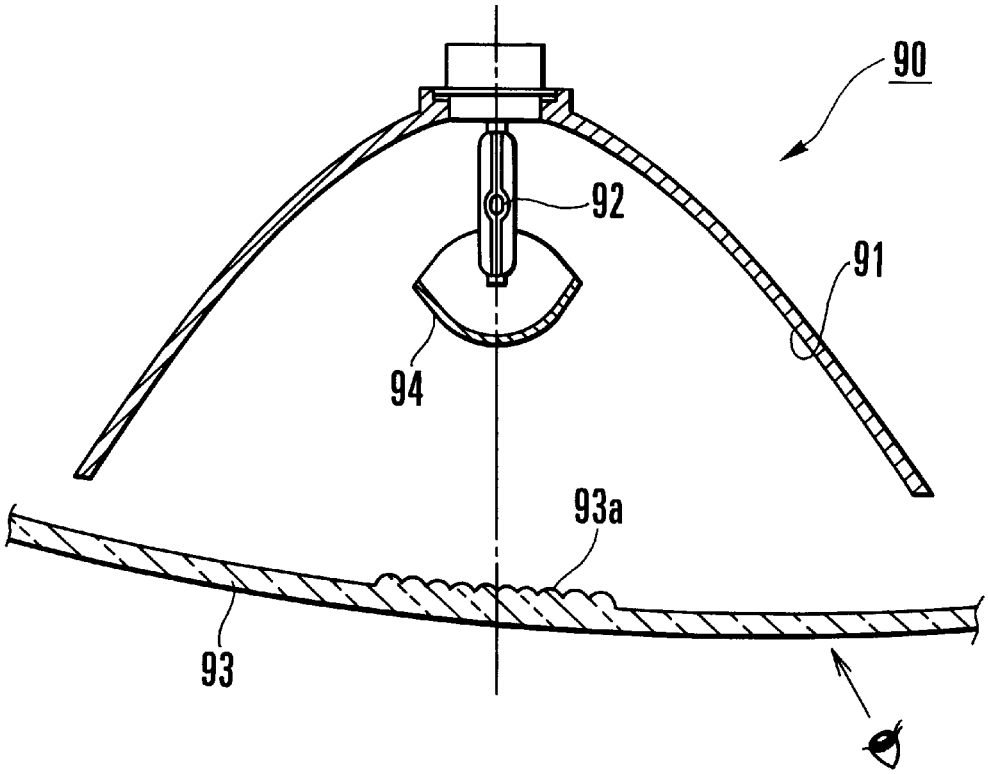
FIG. 9 PRIOR ART
FIG. 9 illustrates a cross-sectional view along a line II—II of the conventional automobile lamp in FIG. 8.

FIG. 7 illustrates a perspective view of the third preferred embodiment of the present invention. A composition of the automobile headlight 1 or 1' may be used for signaling function as a brake or stop lamp or a turn-signal lamp, or may be used for illumination as a back-up lamp. The automobile rear light 50 comprises a brake or stop lamp 10, a turn-signal lamp 20, and a back-up lamp 30. Since the stop lamp 10, the turn-signal lamp 20, and the back-up lamp 30 have substantially the same composition as the automobile headlight 1, the automobile lamp 50 has high design uniformity in appearance. The stop lamp 10, the turn-signal lamp 20, and the back-up lamp 30 have predetermined light distribution patterns depending on their functions.

It will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. An automobile lamp comprising a light source, a shade covering the light source, a reflector with an aperture, an outer lens covering the aperture, and an inner lens arranged vertically between the shade and the outer lens wherein:

the reflector comprises a central reflecting surface directing light emitted from the light source to the inner lens, a left reflecting surface, and a right reflecting surface;

the inner lens substantially covers the central reflecting surface of the reflector;

light distribution patterns are formed by light reflecting from the left and right reflecting surfaces and light passed through the inner lens;

the inner lens is substantially V-shaped having a vertex in an illuminating direction, and has at least one prismatic cut arranged on an inner surface symmetrically relative to a horizontal line passing through the vertex and center of the light source, such that a series of prismatic cuts are shaped as a series of right circular cylinders, and at least one light-transmitting cut arranged on an outer surface symmetrically in steps relative to a horizontal line passing through the vertex and center of the light source.

2. The automobile lamp according to claim 1, wherein the reflector comprises at least one non-reflecting surface which is positioned between the central reflecting surface and the left or right reflecting surface.

3. The automobile lamp according to claim 1, wherein the inner lens is substantially U-shaped, comprising a plate having at least one prismatic cut on an inner surface, and ribs projecting internally on the left and right ends of the plate.

4. The automobile lamp according to claim 1, wherein the automobile lamp is configured as a brake lamp.

5. The automobile lamp according to claim 1, wherein the automobile lamp is configured as a turn-signal lamp.

6. The automobile lamp according to claim 1, wherein the automobile lamp is configured as a back-up lamp.

7. The automobile lamp according to claim 1, wherein the outer lens is circular.

8. An automobile lamp assembly comprising:

a light source having a base portion for connection to a power source;

a shade covering the light source;

an inner lens covering the shade; and a reflector having a central reflecting surface that directs light emitted from the light source to the inner lens, a left reflecting surface connected to the central reflecting surface, and a right reflecting surface connected to the central reflecting surface, wherein:

light distribution patterns are formed by the inner lens, the left reflecting surface, and the right reflecting surface; and the base portion of the light source and shade covering the light source are not visible from outside of the automobile lamp assembly;

the inner lens is substantially V-shaped having a vertex in an illuminating direction, and has at least one prismatic cut arranged on an inner surface symmetrically relative to a horizontal line passing through the vertex and center of the light source, such that a series of prismatic cuts are shaped as a series of right circular cylinders, and at least one light-transmitting cut arranged on an outer surface, symmetrically in steps relative to a horizontal line passing through the vertex and center of the light source.

9. The automobile lamp assembly according to claim 8, wherein the central reflecting surface of the reflector is in the shape of a rotated parabolic surface with a focus on the light source.

10. The automobile lamp assembly according to claim 9, wherein the shape and position of the central, left, and right reflecting surfaces allow only light reflected by the central reflecting surface to pass through the inner lens.

11. The automobile lamp assembly according to claim 8, wherein the inner lens has prismatic cuts on an inner surface for diffusing light reflected by the central reflecting surface into a substantially horizontal direction.

12. The automobile lamp assembly according to claim 11, wherein the prismatic cuts on the inner surface of the inner lens are a series of substantially right circular cylinders extending substantially perpendicular to said horizontal line.

13. The automobile lamp assembly according to claim 8, wherein the inner lens has light-transmitting cuts arranged on an outer surface.

14. The automobile lamp assembly according to claim 13, wherein the light-transmitting cuts arranged on the outer surface of the inner lens are arranged like symmetrical stairs relative to a line passing through the vertex of the inner lens and center of the light source.

15. The automobile lamp assembly according to claim 8, wherein the inner lens is substantially V-shaped.

16. The automobile lamp assembly according to claim 8, wherein the inner lens is substantially U-shaped.

17. The automobile lamp assembly according to claim 16, wherein the U-shaped inner lens comprises a plate, ribs on left and right ends of the plate, and prismatic cuts on an inner surface of the plate.

18. The automobile lamp assembly according to claim 8, wherein the reflector further comprises at least one non-reflecting surface between the central reflecting surface and the left or right reflecting surface.

19. An automobile lamp assembly comprising:

a light source having a base portion for connection to a power source;

a shade covering the light source;

an inner lens covering the shade; and a reflector having a central reflecting surface that directs light emitted from the light source to the inner lens, a left reflecting surface connected to the central reflecting surface, and a right reflecting surface connected to the central reflecting surface, wherein:

light distribution patterns with uniform luminous flux density distribution, free from any conspicuous luminous flux density gap in the light distribution patterns, are formed by reflections from the inner lens, the left reflecting surface, and the right reflecting surface;

the inner lens is substantially V-shaped having a vertex in an illuminating direction, and has at least one prismatic cut arranged on an inner surface symmetrically relative to a horizontal line passing through the vertex and center of the light source, such that a series of prismatic cuts are shaped as a series of right circular cylinders, and at least one light-transmitting cut arranged on an outer surface, symmetrically in steps relative to a horizontal line passing through the vertex and center of the light source.

20. The automobile lamp assembly according to claim 19, wherein the reflector further comprises at least one non-reflecting surface between the central reflecting surface and the left or right reflecting surface.

* * * * *